US007665274B2

(12) United States Patent
Gustafsson

(10) Patent No.: US 7,665,274 B2
(45) Date of Patent: Feb. 23, 2010

(54) DEVICE AND METHOD FOR GAS FILLING OF A DUCT IN A CONTAINER

(75) Inventor: Per Gustafsson, Bjärred (SE)

(73) Assignee: Eco Lean Research & Development A/S, Copenhagen (DK)

( * ) Notice: Subject to any disclaimer, the term of this patent is extended or adjusted under 35 U.S.C. 154(b) by 12 days.

(21) Appl. No.: 11/919,227

(22) PCT Filed: May 8, 2006

(86) PCT No.: PCT/SE2006/000545

§ 371 (c)(1),
(2), (4) Date: Dec. 31, 2007

(87) PCT Pub. No.: WO2006/121388

PCT Pub. Date: Nov. 16, 2006

(65) Prior Publication Data

US 2008/0209854 A1 Sep. 4, 2008

(30) Foreign Application Priority Data

May 13, 2005 (SE) ..... 0501080

(51) Int. Cl.
*B65B 31/00* (2006.01)

(52) U.S. Cl. ..... 53/88

(58) Field of Classification Search ..... 53/88, 53/403, 433, 434

See application file for complete search history.

(56) References Cited

U.S. PATENT DOCUMENTS 4,216,639 A 8/1980 Gautier (Continued)

FOREIGN PATENT DOCUMENTS

GB 1 598 843 A 9/1981

(Continued)

*Primary Examiner*—Louis K Huynh
(74) *Attorney, Agent, or Firm*—Birch, Stewart, Kolasch & Birch, LLP

(57) ABSTRACT

The invention relates to a device for gas filling of a duct (7) in a container (1) of a collapsible type, said duct (7) being defined by a first and a second side wall (2) of the container (1), the side walls (2) being joined along a common connecting portion (4), and said duct (7) comprising an inlet (15) arranged in the first side wall (2). The device comprises an abutment (21) and a gas module (26) with an outlet (28), which is arranged in a surface of the gas module (26) facing the abutment (21), and a clamping means (29) arranged outside the outlet (28), which clamping means (29) is applicable to the abutment (21) for clamping the container (1), and which outlet (28), in connection with the clamping of the container (1), is applicable to said inlet (15) for supply of gas to the duct (7) of the container. The device is characterized by a groove (30) formed in said surface of the gas module (26), which groove surrounds the outlet (28) and is positioned radially inside said clamping means (29), said groove (30) being arranged to prevent, when supplying gas to the duct (7) intended to be filled with gas, build-up of a pressure above atmospheric on the side, facing the gas module, of said first side wall (2) surrounding said inlet (15). The invention also relates to a method for filling such a duct with gas.

8 Claims, 5 Drawing Sheets

U.S. PATENT DOCUMENTS

| | | | | |
|---|---|---|---|---|
| 4,270,999 | A * | 6/1981 | Hassan et al. | 204/192.32 |
| 5,556,560 | A * | 9/1996 | Ahola et al. | 219/121.45 |
| 2004/0035865 | A1 | 2/2004 | Rosen | |
| 2007/0086118 | A1 * | 4/2007 | Matsumura et al. | 360/265.8 |

FOREIGN PATENT DOCUMENTS

| | | | |
|---|---|---|---|
| WO | WO 99/41155 | A1 | 8/1999 |
| WO | WO 2005/030599 | A1 | 4/2005 |

* cited by examiner

DEVICE AND METHOD FOR GAS FILLING OF A DUCT IN A CONTAINER

TECHNICAL FIELD

The present invention relates to a device for gas filling of a duct in a container of a collapsible type, said duct being defined by a first and a second side wall of the container, the side walls being joined along a common connecting portion, and said duct comprising an inlet arranged in the first side wall. The invention also relates to a method for filling such a duct with gas.

BACKGROUND ART

It has been known for a long time to use containers of a collapsible type. The contents can be both in liquid and in powder form.

By a container of a collapsible type is meant the type of container that consists of thin flexible walls which are joined in connection portions to define a compartment. The volume of the compartment depends on the relative distance between the walls, which means that the volume depends on the filling ratio of the container. This type of containers may have a number of different handle types, for instance gas-filled handles for improved grippability.

Containers of a collapsible type are as a rule filled through a duct/opening which is defined by two opposite walls of the container. Such filling occurs with the container in an upright position, in which case the filling nozzle can act essentially in the vertical direction and be introduced into the duct between the two walls. This is a method that is well established and well functioning when supplying fluids in liquid form. The same method, however, causes great problems when supplying fluids in gaseous form due to difficulties in providing a gas-tight seal around the nozzle while the gas is being supplied. Additional problems arise when the gas-filled duct is to be sealed.

A solution to these problems is that the duct is filled with gas through a check valve integrated in the container. This technique is very expensive to apply to mass-produced containers, such as food containers where the duct is to be filled only once.

WO2005/030599 discloses a method and a device for gas filling and sealing of a duct intended to be filled with gas and positioned in a container of a collapsible type, where the duct has an inlet arranged in one of its side walls. During filling with gas, that part of the container which comprises the inlet is clamped between an abutment and a gas module which is axially movable towards the abutment in such a manner that one of the two side walls included in the duct is allowed to bulge to form a free passage into the duct, in response to a gas flow supplied from the gas module. After completion of the gas filling, the duct is sealed. However, it is difficult to ensure a correct filling ratio of the ducts, that is a repeatable and sufficiently high pressure, since it is difficult to seal against the inlet during filling. This can be compensated for by taking a pressure above atmospheric from the used source of compressed air based on the estimated pressure loss due to leakage. However, repeatability is insufficient, which results in some ducts being insufficiently filled whereas others are filled to such an extent that they quite simply burst.

Therefore there is a need for a method and a device for gas filling of such ducts in collapsible containers, independently of the purpose of the gas-filled ducts, in which the necessary repeatability is ensured.

OBJECTS OF THE PRESENT INVENTION

The object of the present invention is to provide a device and a method for gas filling of ducts in containers of a collapsible type.

The method and the device should be easy to use and allow a high rate of production and great reliability.

The method and the device should be arranged so that no new material or components in the form of, for instance, check valves, have to be added to the container blank or the container.

The method and the device should also be applicable to a container blank.

SUMMARY OF THE INVENTION

To achieve at least one of the above objects and also other objects that will appear from the following description, a device and a method having the features stated in claims 1 and 10 are provided according to the present invention.

More specifically, a device for gas filling of a duct in a container of a collapsible type is provided, said duct being defined by a first and a second side wall of the container, the side walls being joined along a common connecting portion, and said duct comprising an inlet arranged in the first side wall, said device comprising an abutment and a gas module with an outlet, which is arranged in a surface of the gas module facing the abutment, and a clamping means arranged outside the outlet, which clamping means is applicable to the abutment for clamping the container, and which outlet, in connection with the clamping of the container, is applicable to said inlet for supply of gas to the duct of the container. The device is characterised by a groove formed in said surface of the gas module, which groove surrounds the outlet and is positioned radially inside said clamping means, said groove being arranged to prevent, when supplying gas to the duct intended to be filled with gas, build-up of a pressure above atmospheric on the side, facing the gas module, of said first side wall surrounding said inlet.

A device according to the invention ensures when supplying gas to the duct intended to be filled with gas, due to the prevention of build-up of a pressure above atmospheric on the side, facing the gas module, of said first side wall enclosing said inlet, that is on the upper side of the first side wall, that said first side wall can take a position separated relative to the second side wall. This means that the duct is opened, thereby eliminating, or at least minimising, gas leakage in connection with the filling of gas. This ensures very high repeatability regarding the final gas pressure in a gas-filled and sealed duct. By using the device, production economy will be increased because of less rejects.

The construction of the device is very simple. The gas module allows the same working direction for all functions, that is holding of the container, filling its duct with gas and the subsequent sealing. Moreover, the device requires no extra means on the container in the form of check valves for instance. The device is applicable to containers as well as to container blanks.

A duct can be formed in said gas module, through which duct said groove communicates with the environment. It is thus easily achieved that the groove acts to prevent build-up of a pressure above atmospheric on the upper side of the first side wall.

The abutment of the device may have a recess to allow bulging of the second side wall to provide a passage into the duct intended to be filled with gas, when said outlet in connection with the clamping of the container is applied to said inlet for supply of gas to the duct of the container.

The recess in the abutment can have such an extent that, when clamping the container between the clamping means and the abutment, it extends past said clamping means. Such an extent can be provided to give extra stability and guiding of the container while being clamped, but above all to prevent the clamping from jeopardising free passage into the duct.

The gas module can be axially applicable to the abutment to provide said clamping of the container.

The device may further comprise a sealing means which is adapted to disconnect, by sealing, the inlet from the duct after filling the duct with gas. With a sealing means, no valves or special devices are required to ensure a gas-tight seal of the duct, and in particular no extra cost-intensive applications on the container.

The sealing means may comprise a heating jaw arranged outside the abutment and a mandrel arranged outside the gas module, said mandrel being engageable with said heating jaw. With this position outside the gas module and the abutment, respectively, the sealing means can easily be synchronised with the movement of the gas module.

The abutment can be made of a material with low thermal conductivity. Furthermore the abutment may comprise cooling means, in particular if the abutment is surrounded by a heating jaw. This eliminates the risk that the abutment reaches such a temperature that the container material is thermally affected and provides uncontrolled joining of the container material.

According to another aspect, the invention relates to a method for gas filling of a duct in a container of a collapsible type, said duct being defined by a first and a second side wall of the container, which side walls are joined along a common connecting portion, and said duct comprising an inlet arranged in the first side wall. The method comprises the steps of clamping the container between an abutment and a gas module which is axially movable towards the abutment, in which clamping the first side wall comprising said inlet is positioned in such a manner relative to a groove formed in the gas module in a surface facing the abutment that the groove surrounds said inlet, and the second side wall is allowed to bulge in response to a gas flow supplied to the duct through said inlet to form a passage for filling the same with gas, connecting said groove with the environment, supplying through an outlet in the gas module a gas flow into said duct through said inlet, whereby the groove connected with the environment prevents build-up of a pressure above atmospheric on the side, facing the gas module, of said first side wall surrounding said inlet, and after completion of the gas filling sealing the duct.

The method according to the invention ensures, due to the prevention of build-up of a pressure above atmospheric on the upper side of the first side wall, as described above, that the duct is opened when gas is supplied, thereby eliminating or at least minimising gas leakage. This ensures a very high repeatability regarding the final gas pressure in a gas-filled and sealed duct. With the method, production economy will be increased because of less rejects.

The clamping of the container can be provided by a clamping means arranged outside the outlet.

The duct can be filled to a pressure above atmospheric in the range 1-3 bar. It will be appreciated that the pressure is selected based on the function and desired rigidity of the duct.

After completion of the gas filling, the duct is advantageously sealed by application of heat and pressure. The duct can be sealed by a sealing means comprising a mandrel arranged outside the gas module and a heating jaw arranged outside the abutment, which heating jaw in sealing axially engages said mandrel.

To facilitate separation of the side walls when filling the duct with gas and to facilitate bulging of the second side wall, the second side wall is, in its surface which in clamping is allowed to bulge, advantageously provided with an embossing.

DESCRIPTION OF DRAWINGS

The invention will now be described in more detail by way of example and with reference to the accompanying drawings which illustrate currently preferred embodiments of the device, the method, a container blank and a container made thereof.

TECHNICAL DESCRIPTION

Figure 1:
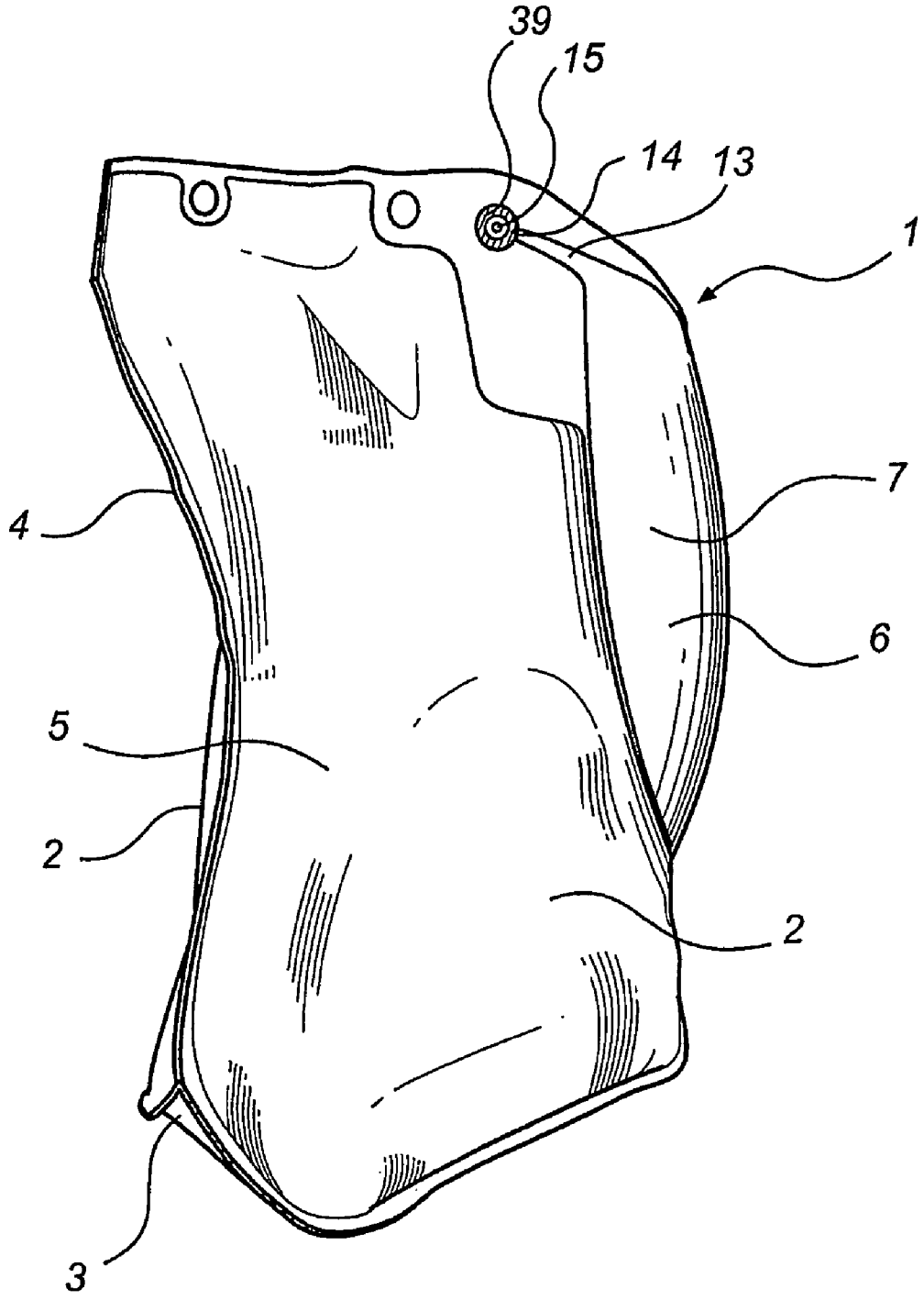
FIG. 1 shows an example of a container of a collapsible type comprising a gas-filled, handle-forming duct.

With reference to FIG. 1, an example of a collapsible container 1 is shown, to which the present device and method have been applied.

The container is especially intended for liquid foodstuffs, but may, of course, also be intended for products in some other form or for other purposes.

The container comprises three flexible walls, two of which constitute side walls 2 and the third constitutes a bottom wall 3. The walls are joined along connecting portions 4 to define a compartment 5. The walls 2, 3 are made of a bendable and flexible material, which means that the volume of the compartment 5 depends on the relative distance between the walls 2, 3. The volume of the compartment 5 is thus directly dependent on the filling ratio of the container 1. In other words, the container is of a collapsible type.

A handle 6 is arranged in the connecting portion 4 at the rear end of the container 1. The handle 6 consists of a gas-filled duct 7 which is defined by the connecting portion 4 and the side walls 2 of the container 1. By gas is preferably meant air, but of course also other gases or even liquids may be used. The handle 6 has such a geometry and filling ratio as to form an easy-to-grip bead. The handle 6 also promotes by its geometry and gas filling a considerable rigidity of the container 1.

Generally it is desirable for the selected container material to consist of a laminate comprising a core layer of mineral-based filler and a binder of polyolefin. It will be appreciated that also other materials are possible.

Figure 2:
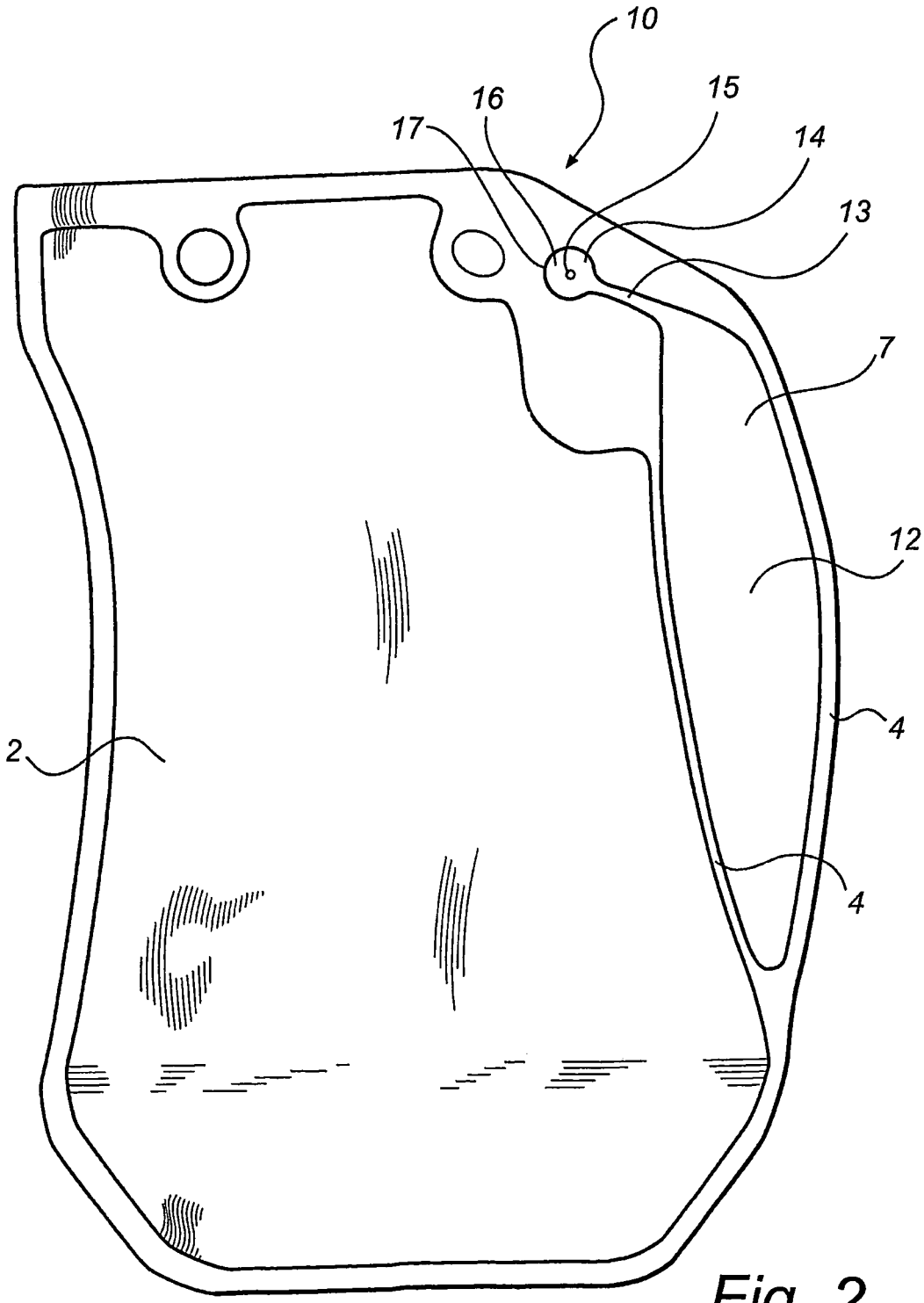
FIG. 2 shows a container blank corresponding to the container shown in FIG. 1.

With reference to FIG. 2, a container blank 10 corresponding to the container 1 shown in FIG. 1 is illustrated.

At the rear end of the container blank 10, the handle-forming duct 7 intended to be filled with gas is shown. In the embodiment illustrated, the duct 7 is divided into three segments, which all communicate with each other. The first segment 12 is adapted to form the actual handle 6. The first segment 12 is thus the segment which gives the completed container the desired function, whether, like in the shown and described example, it consists of a handle or it provides some other function, such as a stiffening effect. A second segment 13 is directly connected to the first segment 12 and constitutes a narrow duct that will be described below. A third segment 14 is directly connected to the second segment 13. The third segment 14 consists in its simplest form of an area with a hole 15 in one side wall 2. The hole 15 constitutes an inlet 15 to the duct 7; through which inlet the duct communicates with the environment before being filled with gas and sealed. In the following description of the device and the method, the term "free surface" 16 is used. By this is meant the surface of the third segment 14 which comprises the inlet 15 and which is defined by the connection portion 17 around the third segment 14.

The second side wall of the third segment advantageously exhibits an embossing (not shown). The purpose of this embossing will be described below.

As mentioned above, the second segment 13 consists of a narrow duct. Its main function is to form a surface over which a means for sealing the duct 7 after completion of the gas filling can be arranged. The cross-sectional area of the second segment 13 is substantially smaller than the cross-sectional area of the first segment 12. By cross-sectional area is in this case meant the surface area which the side walls can make up between them transversely to the longitudinal direction of the duct. This difference in cross-sectional area means that the gas pressure in a gas-filled and sealed duct 7 is capable of expanding the first segment 12 to the required volume, but not the second segment 13. Thus, the second segment 13 will constitute a substantially flat surface also when the duct 7 is filled with gas. The sealing of the duct 7 transversely to the second segment 13 can thus be performed without first having to expel a considerable amount of gas before the two opposite side walls 2 which define the duct 7 can be brought into contact with each other for sealing. To achieve this effect, the ratio of the cross-sectional area of the second segment 13 to that of the first segment 12 should be at least 1:150 in a circular cross-sectional geometry. However, it will be appreciated that the duct 7 can be given other shapes and be sealed in other ways.

In the following the device that is intended for filling the above described duct with gas will be described with reference to FIG. 3. The device may constitute a module in equipment (not shown) that is used to manufacture a completed container from a container blank. The device will be described in relation to a container. However, it will be appreciated that the device can also be used on a container blank.

Figure 3:
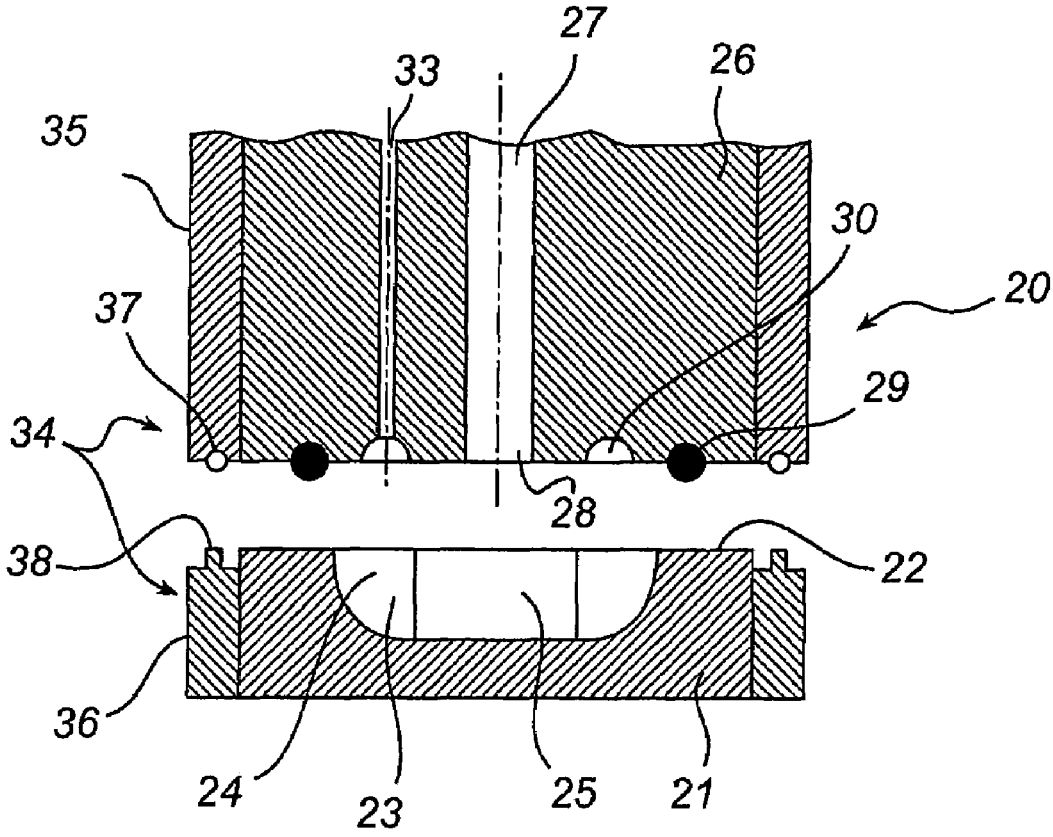
FIG. 3 is a schematic cross-sectional view of the inventive device.
Figure 4:
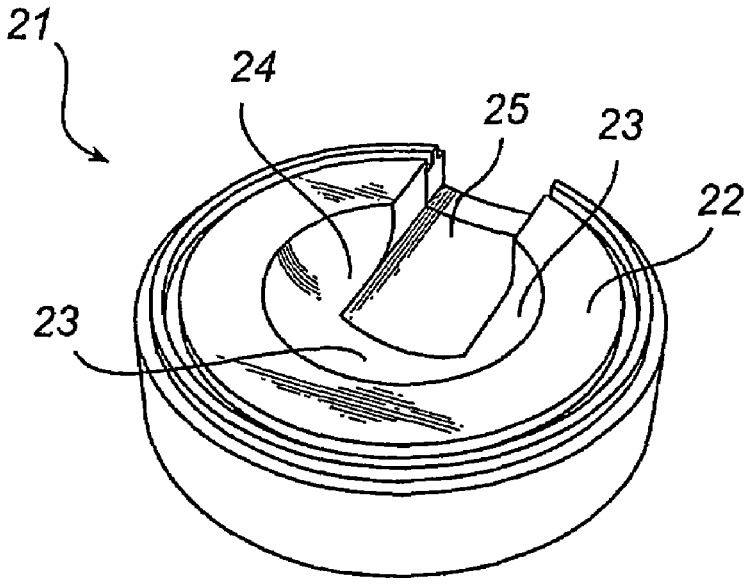
FIG. 4 illustrates an abutment according to the invention.

The device 20 comprises an abutment 21 which in its upper surface 22 has a recess 23, see FIGS. 3 and 4. The recess 23 has a geometry corresponding to the above-described third 14 and second segments 13 of the duct 7. In the embodiment illustrated, the recess 23 has a circular first portion 24 and a second portion 25 which has a radial extent relative to the first portion 24 which coincides with the extent of the second segment 13 of the duct 7. The second portion 25 of the recess 23 is, however, broader than the second segment 13 of the duct 7.

Although the recess 23 is illustrated with a cup-shaped geometry in the surface 22 of the abutment 21, it can be formed as a recess extending through the entire thickness of the abutment. The recess is preferably provided with soft radii to prevent the container material from being damaged.

The abutment 21 should be made of a material with low thermal conductivity, for instance insulated fibreglass. By low thermal conductivity is here meant that the abutment, even if it is surrounded by a heating jaw that has a sufficiently high temperature for melting of the material used in the container, has a temperature which prevents melting of a container material which abuts against the abutment.

The abutment may also comprise cooling means (not shown) to ensure a suitable temperature.

With reference once more to FIG. 3, the device 20 further comprises a gas module 26 which is axially movable towards the abutment 21 for clamping the container between the abutment 21 and the gas module 26. During clamping, the container is oriented relative to the abutment so that the second segment of the duct is arranged over the second portion of the recess and the third segment of the duct is arranged over the first portion of the recess.

The gas module 26 has a first axial duct 27 for supply of gas. The duct 27 opens at its lower end facing the abutment 21 into an outlet 28. The outlet 28 is preferably circular in cross-section. The duct 27 is at its other end connected to a compressed air source (not shown).

The gas module 26 further has a clamping means 29 which is arranged in the surface of the gas module 26 which faces the abutment 21. The clamping means 29 may consist of an O ring of a flexible material which is arranged in a groove in said surface. However, the clamping means can also be designed in other ways, for instance in the form of a shoulder formed in one piece with the gas module. During clamping, the clamping means 29 is adapted to act on a surface of the abutment 26 which is radially outside the recess 23. It will be appreciated that there will be no clamping effect in the area above the second portion of the recess.

The gas module 26 has also in the same surface, radially inside the clamping means 29, a groove 30 which surrounds the outlet 28. The groove 30 is arranged in such a manner relative to the first portion 24 of the recess 23 of the abutment 21 that the groove 30, seen in the plane shown in FIG. 3, is positioned radially inside the outer boundary line of the first portion 24.

With new reference to FIG. 3, the groove 30 communicates with the environment through a second axial duct 33 which is formed in the gas module 26.

Figure 5:
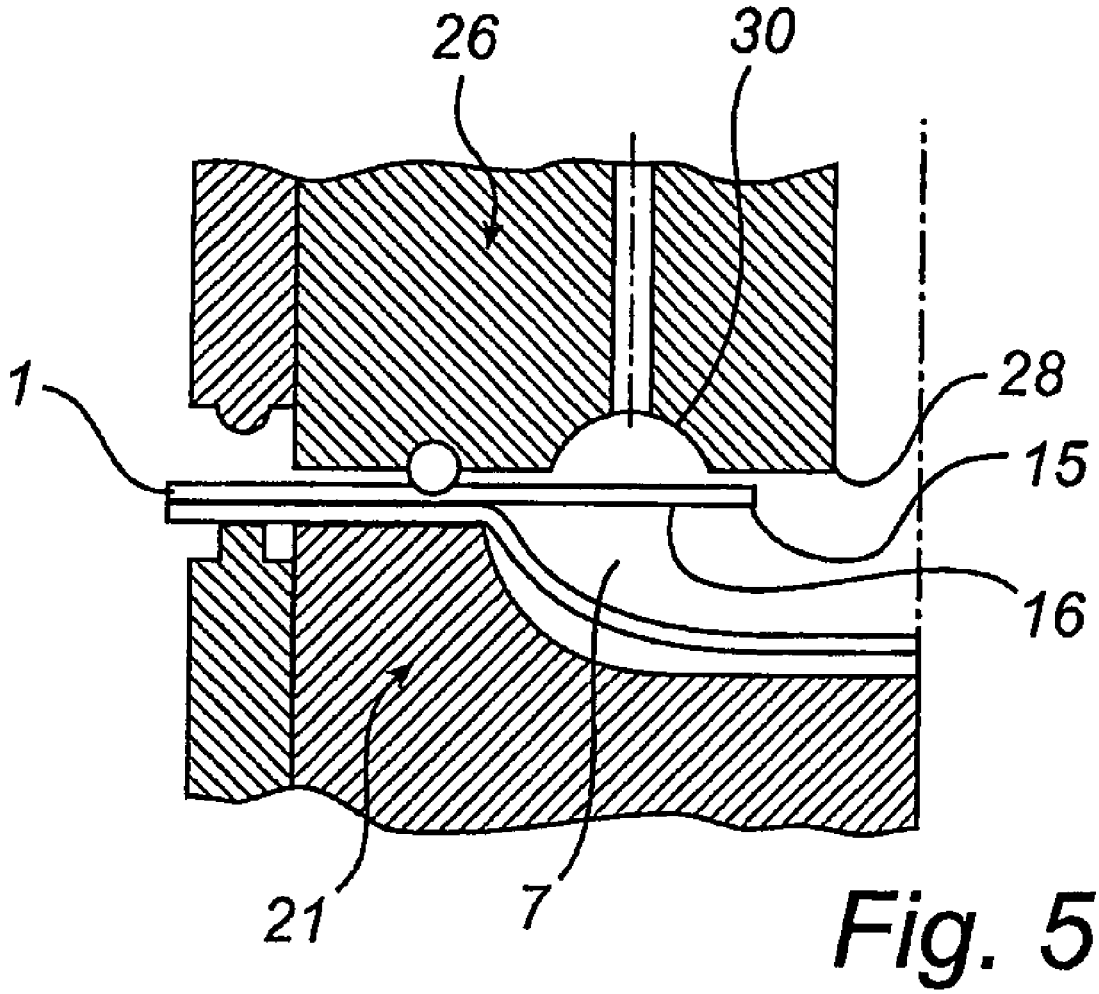
FIG. 5 illustrates a container which is clamped between a gas module and an abutment when filling the duct with gas.

Reference is now made to FIG. 5 which shows that the groove 30, when clamping a container, is arranged in such a position relative to the inlet to the duct 7 of the container that the groove 30 surrounds the inlet 15 but at the same time is positioned radially inside the connecting portion 17, see FIG. 1 of the container 1 which defines the third duct segment 14.

The position of the groove 30 relative to the inlet 15 means that when a container 1 is clamped between the abutment 21 and the gas module 26 and gas is supplied through the duct 27, build-up of a pressure above atmospheric on the side, facing the gas module, of the first side wall which surrounds said inlet 15 will be prevented. The build-up of a pressure above atmospheric is prevented more specifically by the gas being allowed, in a controlled manner, to leak out to the environment through the duct 33, which will be described in more detail below.

When the duct 7 has been filled to the necessary pressure, the duct is sealed. Sealing can occur in various ways. A simple and preferred solution is to use a sealing means 34, see FIG. 3. The sealing means 34 suitably comprises a mandrel 35 and a heating jaw 36. The mandrel 35 is arranged to concentrically surround the gas module 26. The mandrel 35 is further arranged so as to face the abutment 21 and be axially movable towards the same for engagement with the heating jaw 36. The mandrel 35 can be designed in different ways, for instance with a flexible O ring 37. In operation of the device, the mandrel 35 is adapted to form an abutment surface for a projection 38 of the heating jaw 36. In the shown embodiment, the heating jaw 36 surrounds the abutment 21 concentrically.

The heating jaw 36 has a projection 38 which has an extent corresponding to the desired sealing surface 39 of the duct 7, see FIG. 1, that is the seal which disconnects the first segment 12 of the duct 7 from the rest of the duct 7. In the case shown, the annular projection 38 provides an annular sealing surface 39 around the inlet 15 in the third segment 14. The sealing surface 39 can also extend over part of the second segment 13.

The function of the device and thus also the method will be described in the following. This occurs with reference to FIGS. 6*a*-6*f*.

Figure 6A:
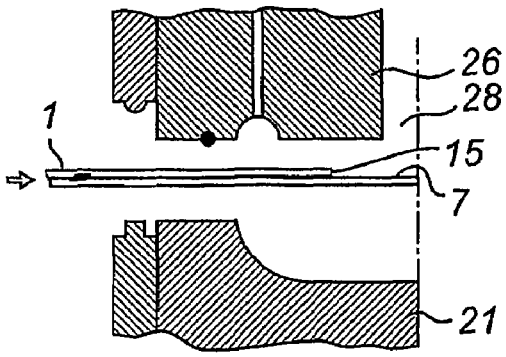
FIGS. 6*a*-6*f* illustrate schematically the process of gas filling and sealing of a duct according to the inventive device and method.

Starting from FIG. 6*a*, a container 1 is inserted between the abutment 21 and the gas module 26. The container is oriented (not shown) so that the second segment of the duct is arranged over the second portion of the recess in the abutment and the third segment of the duct is arranged over the first portion of the recess in the abutment. The container 1 is further oriented so that the inlet 15 of the duct 7 faces the outlet 28 in the gas module 26.

Figure 6B:
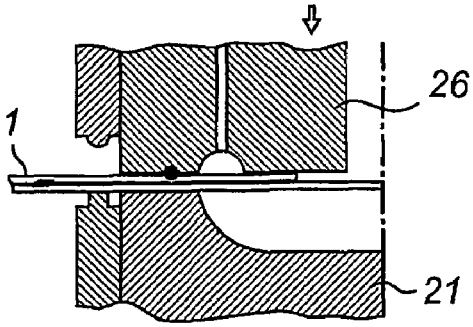
Figure 6C:
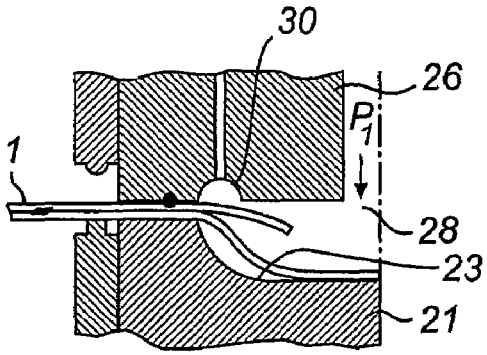

With reference to FIG. 6*b*, the container 1 is clamped between the abutment 21 and the gas module 26 by the gas module 26 being moved axially into abutment against the abutment 21, whereby the clamping means 29 in cooperation with the upper surface 22 of the abutment 21 acts to clamp the container 1.

Subsequently, with reference to FIG. 6 the gas source (not shown) is activated, whereby gas $P_1$ is supplied to the duct 7 through the inlet 15.

Figure 6D:
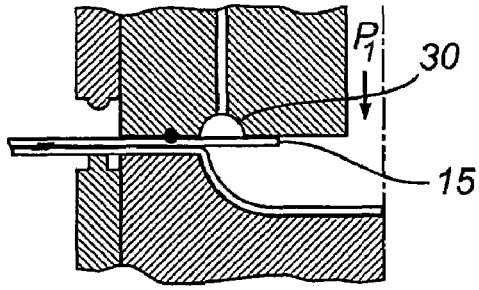
Figure 6E:
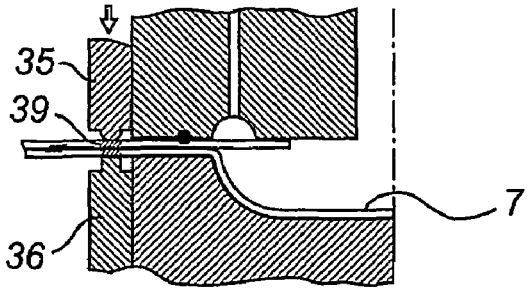

The gas supply causes initially the first and the second side wall in the third segment to bulge in the recess 23 of the abutment 21. However, the second, that is the lower, side wall will bulge to a greater extent than the first side wall. For this purpose, the second side wall can be provided with an embossing as will be described below. The bulge of the second side wall is also provided by the supplied gas impinging on the surface, exposed by the inlet 15, of the second side wall. Thus the gas supply provides initial separation of the side walls in the third segment, which in turn results in a pressure above atmospheric starting to be built up in the third segment between the side walls. As described above, the groove is arranged to prevent build-up of a pressure above atmospheric on the side, facing the gas module, of said first side wall surrounding said inlet 15, that is on the upper side of the first side wall. The flexibility of the first side wall in combination with the pressure above atmospheric that is built up in the third segment will thus result in the first side wall being straightened, which is shown in FIG. 6*d* and which in turn results in the second segment of the duct being opened, thereby forming a free passage for the supplied gas into the first segment of the duct. As a result of the groove 30 preventing the build-up of a pressure above atmospheric on the upper side of the first side wall, the gas supply can thus occur in a controlled manner without considerable leakage. It will be appreciated that a small gas leakage occurs before the first side wall has been straightened, that is as long as the groove acts to prevent build-up of a pressure above atmospheric, but the straightening of the first side wall occurs fairly immediately as soon as the gas is turned on.

By the second side wall 2 in the third segment, that is the side wall opposing the free surface 16, being embossed (not shown), the bulging as well as the separation of the two side walls 2 are facilitated when gas is supplied. The embossing results more specifically in a local surface enlargement which promotes bulging.

The supply of gas $P_1$ is terminated when the duct 7 has reached a required pressure. The required pressure can be, for example, 1-3 bar above atmospheric pressure. Then the duct 7 is sealed, see FIG. 6*e*. Sealing is preferably performed by the mandrel 35 being moved into abutment against the heating jaw 36, thereby forming a sealing surface 39.

Figure 6F:
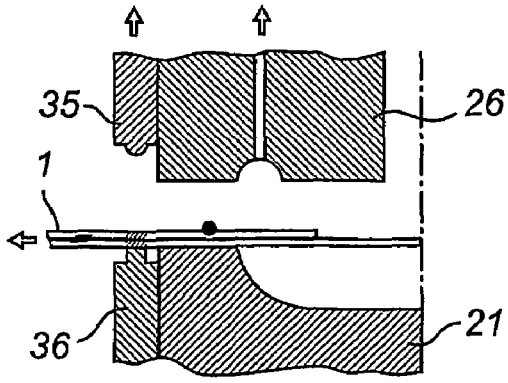

Finally, with reference to FIG. 6*f*, the gas module 26 and the abutment 21 are separated. At the same time also the mandrel 35 and the heating jaw 36 are moved apart. Thus the container 1 is free to be removed from the device.

In the above description, the clamping of the container has occurred by an axial movement of the gas module, thereby clamping the container between the clamping means of the gas module and the abutment. It will be appreciated that the container can be clamped in a number of different ways.

In the description above, the gas module is axially movable towards a fixedly arranged abutment. It will be appreciated that the reverse principle can be applied, viz. that the abutment is axially movable towards a fixedly arranged gas module.

In the description, a pressure above atmospheric of 1-3 bar has been stated as a suitable gas pressure. The pressure above atmospheric depends on the container material used, especially the thickness thereof.

It will be appreciated that the present invention is not limited to the embodiments shown. Several modifications and variants are thus conceivable within the scope of the invention which consequently is exclusively defined by the appended claims.

The invention claimed is:

1. A device for gas filling of a duct in a container of a collapsible type, said duct being defined by a first and a second side wall of the container, the side walls being joined along a common connecting portion, and said duct comprising an inlet arranged in the first side wall, said device comprising:

an abutment; and a gas module with an outlet and a clamping means, the outlet being arranged in a surface of the gas module facing the abutment, and the clamping means being arranged outside the outlet, wherein the clamping means is applicable to the abutment for clamping the container, wherein the outlet, in connection with the clamping of the container, is applicable to said inlet for supply of gas to the duct of the container, wherein the abutment has a recess to allow bulging of the second side wall to provide a passage into the duct intended to be filled with gas, when said outlet, in connection with the clamping of the container, is applied to said inlet for supply of gas to the duct of the container, and wherein a groove is formed in said surface of the gas module, the groove surrounding the outlet and being positioned radially inside said clamping means, said groove being arranged to prevent, when supplying gas to the duct intended to be filled with gas, build-up of a pressure above atmospheric on the side, facing the gas module, of said first side wall surrounding said inlet.

2. The device as claimed in claim 1, in which a duct is formed in said gas module, through which duct said groove communicates with the environment.

3. The device as claimed in claim 1, in which said recess, when clamping the container between the clamping means and the abutment, extends past said clamping means.

4. The device as claimed in claim 1, in which the gas module is axially applicable to the abutment to provide said clamping of the container.

5. The device as claimed in claim 1, further comprising a sealing means which is adapted to disconnect, by sealing, the inlet from the duct after filling the duct with gas.

6. The device as claimed in claim 5, in which the sealing means comprises a heating jaw arranged outside the abutment and a mandrel arranged outside the gas module, said mandrel being engageable with said heating jaw.

7. The device as claimed in claim 1, in which the abutment is made of a material with low thermal conductivity.

8. The device as claimed in claim 1, in which the abutment comprises cooling means.

* * * * *